United States Patent [19]

Ervine

[11] 4,148,243

[45] Apr. 10, 1979

[54] SHOT LOADING MACHINE

[75] Inventor: Albert W. G. Ervine, Bridgeport

[73] Assignee: Remington Arms Company, Inc., Stratford, Conn.

[21] Appl. No.: 799,201

[22] Filed: May 23, 1977

[51] Int. Cl.[2] ..... F42B 33/02

[52] U.S. Cl. ..... 86/23; 86/31

[58] Field of Search ..... 86/4 R, 23–33, 86/20 V, 20 R

[56] References Cited

U.S. PATENT DOCUMENTS

| | | | |
|---|---|---|---|
| 494,905 | 4/1893 | Tenner | 86/27 |
| 1,612,479 | 12/1926 | Wellhauser et al. | 86/20 V |
| 3,097,560 | 7/1963 | Ponaness | 86/29 |
| 3,132,589 | 5/1964 | Schafer | 102/42 R |
| 3,195,461 | 7/1965 | Freed | 102/42 R |
| 4,116,109 | 9/1978 | Ervine | 86/23 |

*Primary Examiner*—Harold Tudor

*Attorney, Agent, or Firm*—William L. Ericson; Nicholas Skovran

[57] ABSTRACT

To uniformly load and orient predetermined charges of shot in shotshells having limited volume, an automatic loading machine meters the charges into the shells in a series of successive increments each sufficient to form only a single layer. A shell-supporting rail of the machine is subdivided into segments which are oscillated by cam and lever means to orient each successive increment of shot into a regular, compact layer.

9 Claims, 9 Drawing Figures

SHOT LOADING MACHINE

BACKGROUND OF THE INVENTION

This invention relates to an improved machine for loading shot charges into shot shells. It finds particular utility in the loading of the relatively large shot sizes, such as buckshot, which are difficult to nest in fully-compacted layers within shot shell casings.

The larger standard sizes of shot, ranging from No. 4 buckshot of 0.24 inch diameter up to No. 00 of 0.33 inch diameter, often tend to jam one another when the charge is dropped into a shotshell casing. This occurrence prevents the shot charge from assuming an orderly and compact layered arrangement, which is necessary for fitting the charge into the limited space available for it, and enabling the shell mouth to be closed and crimped over the shot. A large percentage of buckshot shells is normally rejected during loading operations for this reason.

It has previously been proposed to alleviate this problem by applying conventional industrial vibrators to the loading apparatus. This, however, produces a relatively high-frequency and low-amplitude vibration of the shells, and the results are by no means uniform. Vibration may disturb the lower shot layers as much as the upper ones, or may not displace the large-diameter shot sufficiently to cause them to move into a completely orderly arrangement. Another known method is to insert a pick into the shell casing so as to dislodge any jammed shot and cause it to fall into orderly layered positions. This adds complexity to the equipment, yet is by no means certain to achieve uniformity of results.

BRIEF DESCRIPTION

It is the general object of this invention to improve the uniformity of distribution of shot loaded into shotshell casings, and thereby reduce the proportion of shells which must be rejected in the loading process. It is a more specific object to provide an improved shotshell loading machine having means for distributing successively-added layers of shot in an orderly arrangement. Further objects and advantages will appear as the following description proceeds.

The improved shotshell loading machine includes a support means or rail for slidably supporting a series of shell casings whose open mouths are directed upwardly, and a movable conveyor means or dial which has pockets or other means for receiving the shells and transporting them by intermittent motion to a series of successive shot-loading stations. These mechanisms may be themselves be of a known construction, and the machine may be of a rotary type, such as shown in my copending U.S. patent application Ser. No. 709,811 filed July 29, 1976, now Pat. No. 4,116,109, for "Ammunition Loading Machine," or they may be of a type which conveys the shells by linear motion to a succession of loading stations.

I arrange shot metering and dispensing means at each of a series of the loading stations, whose number corresponds to the number of layers into which the particular size of shot being loaded can be arranged in orderly fashion. Each of the metering and dispensing means is adapted to deliver only the quantity or charge of shot which is required to make up a corresponding layer in the shell casing.

Means are provided for reciprocating the support means or rail, or at least a portion or segment of it which is located beneath the shot loading stations, through repetitive strokes which have a vertical component of direction. This reciprocating motion is controlled in amplitude and frequency to shake or agitate the casings in such manner as to cause each successive shot charge to assume an orderly single-layer arrangement in the shot casing, without destroying the orderly arrangement of any layers previously loaded. One such means that I have found satisfactory is to subdivide a portion of the rail lying under the loading stations into a plurality of segments, and to reciprocate these by means of cam and lever arrangements drivingly connecting the segments with a ram that is vertically reciprocated by the main drive of the loading machine. However, other known reciprocating mechanisms may also be used for the purpose.

I have found that the improved machine materially improves the uniformity of shot arrangement in the loaded shotshells, and thereby reduces the percentage of shells which must be rejected because the protrusion of misoriented shot at the mouth does not allow the shells to be properly closed and crimped.

THE PREFERRED EMBODIMENT

Figure 1:
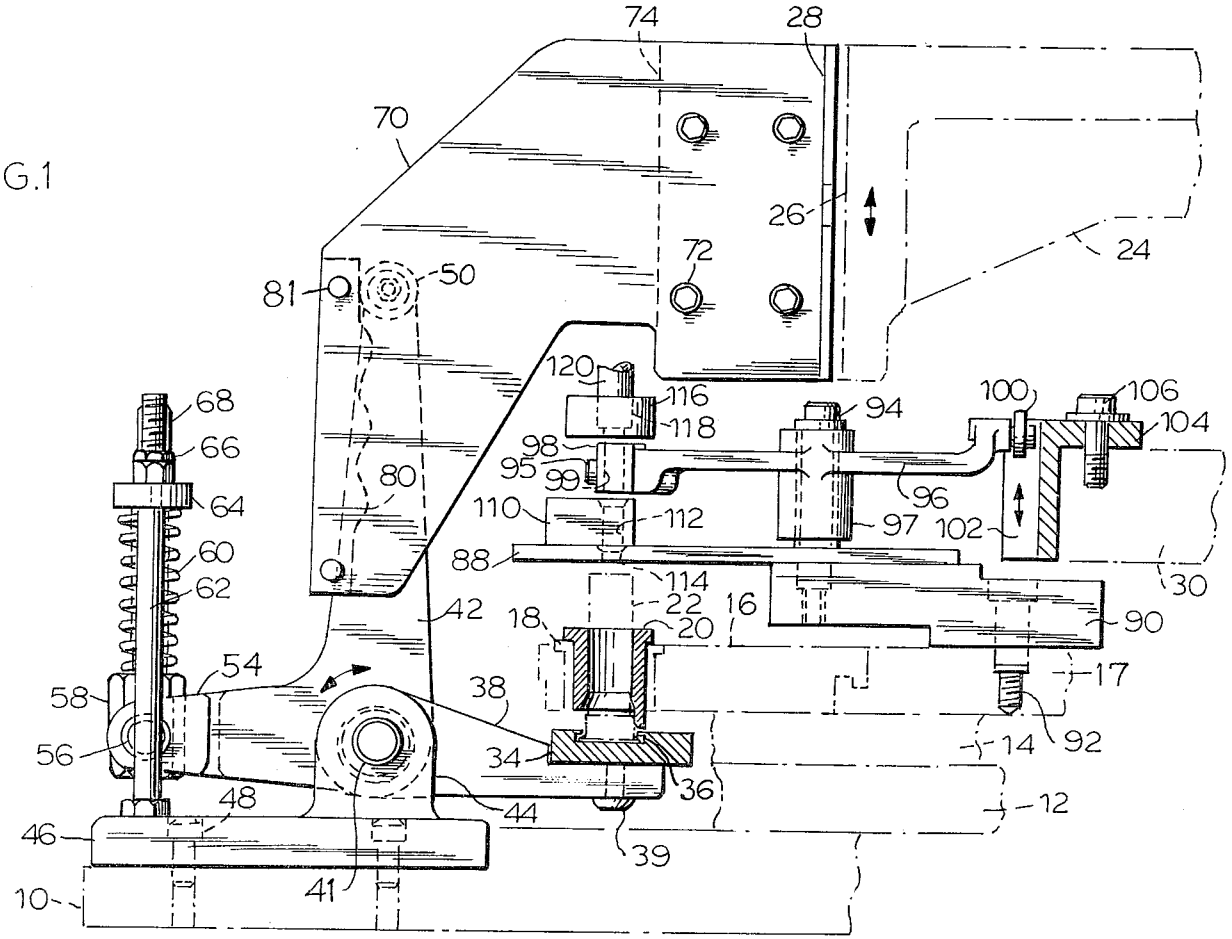
FIG. 1 is a fragmentary view in side elevation of a preferred embodiment of the improved shot loading machine.

Referring first to FIGS. 1-5, the illustrated embodiment of my shot loading machine includes certain portions which are described by my aforementioned copending patent application Ser. No. 709,811; these are shown in dashed lines, and will be described only in general terms sufficient to permit a clear understanding of the present invention. These parts include a base plate 10, a bolster 12, a rail or shell-support means 14, a rotatable dial 16, a main crosshead or ram 24, and an auxiliary crosshead or ram 30. The rail 14 is generally circular in form, but, according to this embodiment, includes a portion made up of arcuate segments 34 which are individually reciprocable by a cam and lever mechanism later to be described. The dial 16, of annular form, supports a plurality of pockets 20 adapted to receive and locate a number of empty shotshell casings 22 at regular intervals circumferentially about its periphery. A central drive mechanism (not shown) intermittently rotates the dial about its major axis, indexing the pockets 20 and the casings 22 in short arcuate steps serially to a number of loading stations, which include shot-loading stations generally indicated at A, B, C, D, E and F in FIG. 2. These stations are aligned vertically beneath a series of shot-loading ports 112, which serve to drop successive charges of shot into each shell as it is indexed from station to station. The bases of the casings 22 are supported and slidably restrained against substantial vertical movement relative to the rail, by means of a conforming T-shaped groove 36 formed in the upper surfaces of the rail segments 34.

The central drive mechanism (not shown) of the machine also causes the main ram 24 and the auxiliary ram 30 to reciprocate vertically, as shown by the arrows in FIG. 1, in synchronism with the indexing movements of the dial 16; the main ram being reciprocated through one full cycle for each indexing step from one loading station to the next, and the auxiliary ram through one-half cycle. Both rams are shown in their lowermost positions in FIG. 1. The main ram is raised through a distance substantially equal to the height of a shell-reciprocating cam 80, and then returned to the illustrated position, in the course of one indexing motion of the dial. The auxiliary ram is raised a distance substantially equal to the height of a shot-dispensing cam 104 during that motion, and is not returned to the illustrated position until the next ensuing indexing motion. These motions are employed to actuate shot dispensing and shell reciprocating mechanisms in a synchronous manner.

As best shown in FIGS. 1 and 3–5, a series of shot metering mechanisms are provided, each of which receives parallel supplies of shot from a hopper (not shown) through a pair of spaced tubes 120 (FIG. 4), and thence through ports 118 in a stationary tube-support bracket 16. Each of these supplies is controlled by a metering block 98, which has two metering passages 99 spaced apart half the distance between the corresponding ports 118. The metering blocks are carried at the outer ends of a plurality of rocker arms 96, each having a hub 97 pivotally mounted by means of a screw 94.

The inner end of each arm 96 mounts a cam follower 100, which is conformably received in a track 102 formed in a corresponding one of the cams 104. These cams are secured by screws 106 to the auxiliary ram 30, and the tracks 102 are so formed as to oscillate the arms 96 and metering blocks 98 in angular directions shown by the arrows in FIG. 3. In the illustrated terminal position, one of the metering passages 99 of each block 98 is aligned above an outlet port 112 in a plate 110 to release a metered charge of shot, (see FIG. 4) while the other passage 99 is aligned beneath one of the supply ports 118 to receive a new charge. The quantity of shot in the charge is metered by the lengths of the passages 99, which are slightly larger in diameter than the individual shot being charged. The vertical clearance between the blocks 98, the bracket 116, and the plates 110 is made insufficient to allow the shot to escape.

The outlet plates 110 are supported by means of a fan-shaped plate 88 secured to an arcuate bracket 90, which is attached by screws 92 to a disc 17 forming a part of the stationary machine base.

At the upper end of the stroke of the ram 30, the arms 96 reach an opposite terminal position in which the blocks 98 locate the previously-filled passages 99 above the outlet ports 112 to deliver their charges, while the previously-emptied passages are located beneath the remaining supply ports 118 to receive new charges. Thus a metered charge is delivered to the shell casings located at each of the stations A–F (FIG. 2) at the end of each indexing movement of the dial 16. The advantage of this arrangement is that it makes available a longer portion of the total machine cycle time for allowing the shot charges to pour in and out of the duplex metering passages 99 than would be the case with single metering passages, and so permits a more rapid loading cycle.

The individual shot charges are volumetrically metered according to the lengths of the passages 99. As is illustrated by a comparison of FIG. 4 with a modified arrangement shown in FIG. 5, in which like parts are similarly numbered with prime superscripts, the metered volume can be adjusted merely by substituting metering blocks 98' having passages 99' of a different height. The volume, and consequently the number, of shot in each metered charge is to be so determined that each will form all or a predetermined part of a single layer in the shotshell, as will be further explained hereinafter.

Figure 2:
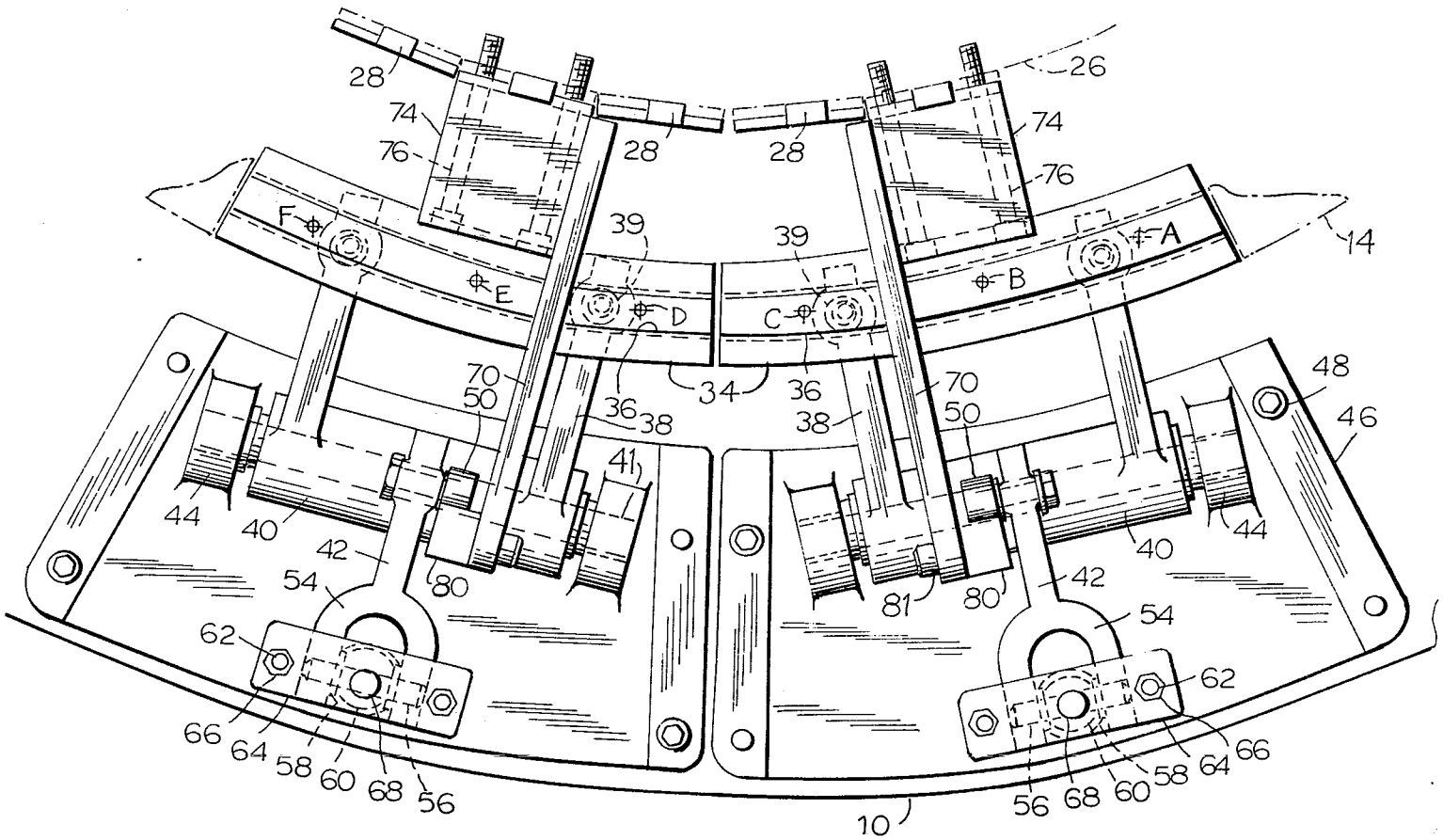
FIG. 2 is a fragmentary plan view of the machine showing cam and lever arrangements for reciprocating a shell support or rail, but omitting shot-dispensing mechanisms for increased clarity.
Figure 3:
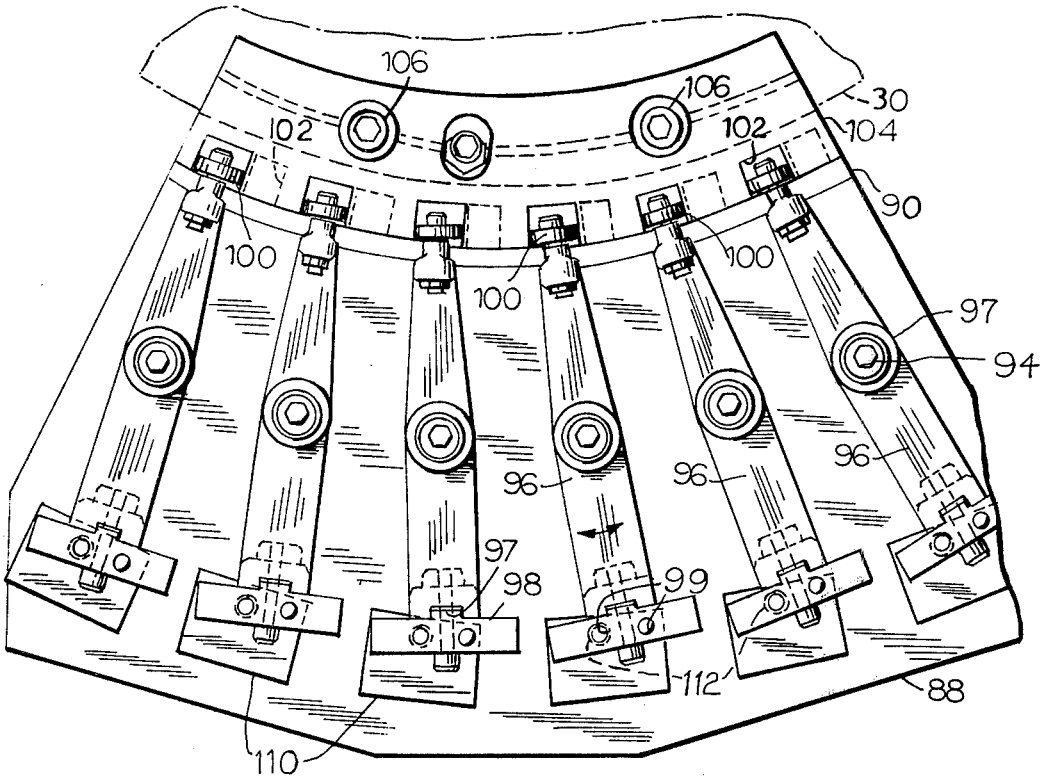
FIG. 3 is a fragmentary plan view showing the shot-dispensing mechanisms, but omitting the cam and lever arrangements of FIG. 2.
Figure 4:
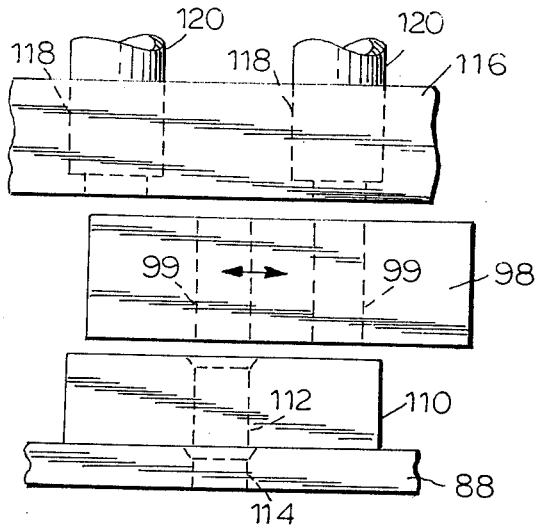
FIG. 4 is a fragmentary view in front elevation showing details of a shot-dispensing mechanism.
Figure 5:
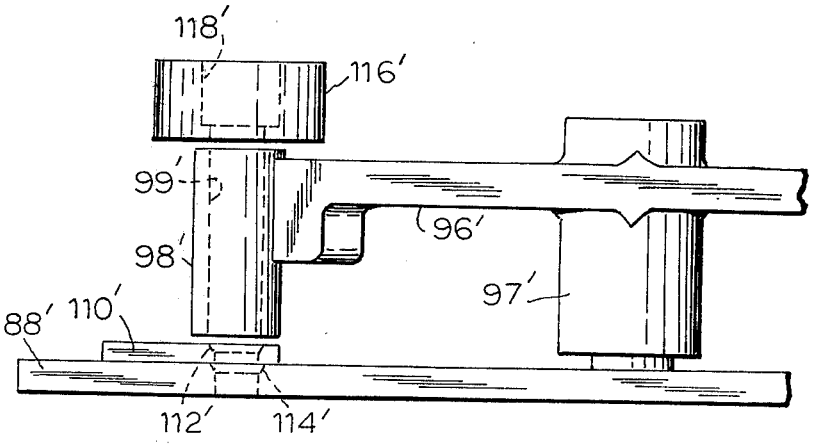
FIG. 5 is a fragmentary view of a shot-dispensing mechanism modified to meter a different shot charge.

Shell reciprocating mechanisms best shown in FIGS. 1 and 2 include the cams 80, which are vertically reciprocated by mounting them on the main ram 24 by means of assemblies of radial arms 70, mounting blocks 74, and pads 28, secured by screws 81, 72, and 76. A cam follower roller 50 cooperating with each of the cams 80 is borne by a follower lever 42, which is integrally formed on a hub 40 together with a bifurcated lever 54 and a pair of rocker arms 38. These arms are attached to a corresponding rail segment 34 by screws 39.

A compression spring 60 acts through a collar 58, and a cross-pin 56 received through the collar and the bifurcated lever 54, to bias the follower lever 42 counterclockwise as viewed in FIG. 1, thereby engaging the roller 50 with the face of the cam 80. The spring 60 is guided on a rod 68 threaded into the collar 58 and slidably received through a plate 64, which is located on a pair of threaded studs 62 by nuts 66 to permit adjustment of the spring compression. Each of the hubs 40 is rockably mounted by means of a shaft 41 rotatable in a pair of bearing blocks 44 formed on an arcuate plate 46, which is affixed to the base plate 10 by screws 48.

The faces of the cams 80 have a series of rises in a repetitive sinusoidal or other wave form, of which the amplitude and wave length combine with the rate of motion of the ram 24, and the ratio of the lengths of the levers 42 and 38, to determine the amplitude and frequency of the repetitive reciprocation of the segments 34 and shells 22 which occurs during the movements of the ram 24. It will be seen that the shells 22 are thus agitated with a controlled vertical motion during the course of the indexing movements of the dial 16, while the shells are passing between loading stations; but the shells remain stationary during the intervals of rest of the ram and dial, during which successive increments of shot are poured into the shells then located at the loading stations A–F.

Figure 6:
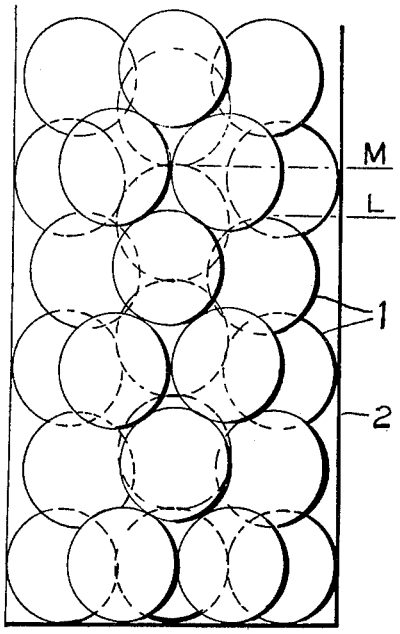
FIG. 6 is a schematic illustration in side elevation of a compact layered arrangement of shot in a shell.
Figure 7:
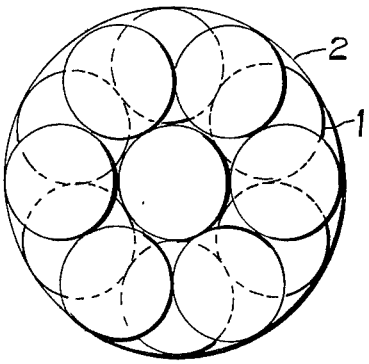
FIG. 7 is a schematic plan view of the shot arrangement of FIG. 6.

The number of shot metered and added to a shell at each loading station A–F is preferably sufficient to form at most a single layer, and in some cases should be slightly less. This will be explained with reference to FIGS. 6 and 7, which illustrate a layer arrangement of maximum orderliness and density of No. 4 buckshot 1 in a 12 gauge shotshell casing generally indicated at 2. The first or bottom layer contains seven shot, arranged in a hexagonal array with a seventh shot in the center. The second layer is similarly oriented, but here the outer hexagonal group drops to some extent into the recesses between the shot of the first layer, while the center shot rests directly on top of the one beneath. As each subsequent layer is added, the resulting difference in the height of the center shot column and the hexagonal ring increases, and it soon becomes difficult for the center shot to nest properly. Therefore, I prefer to drop a charge of only six shot as the third or fourth increment or layer, and then revert to charges of seven shot. It will be seen that in the completed load there are only five shot in the center column, but there are six hexagonal layers. Thus the final height of the shot load is determined by the hexagonal layers, and not by a single center shot protruding above the level at which the shell must be subsequently closed and crimped.

Figure 8:
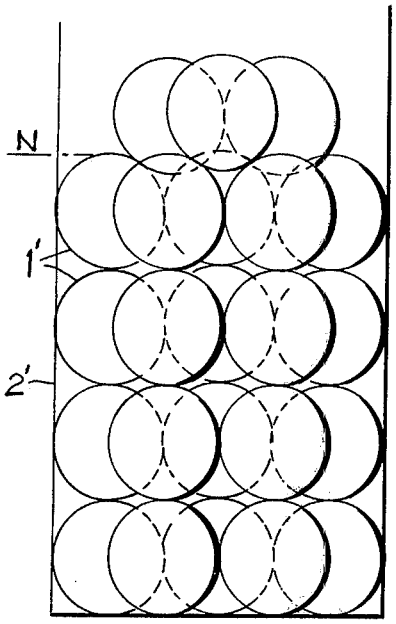
FIG. 8 is a schematic illustration in side elevation showing two incompact layered arrangements of shot in a shell.
Figure 9:
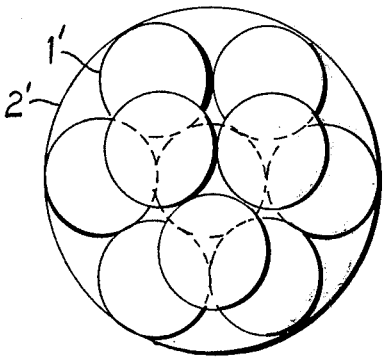
FIG. 9 is a schematic plan view of the incompact shot arrangements of FIG. 8.

FIGS. 8 and 9 illustrate hypothetical cases of misorientation of the shot. The first four layers are shown in an orderly but very unlikely misorientation, in order to most clearly illustrate the accumulation of excess height which also results from other more disorderly and random, but more probable, misorientations. Here, the seven-shot layers are once again arranged in hexagonal outer rings filled by a seventh shot in the center; but all of the shot rest directly on top of those beneath, rather than dropping into the crevices between. The volume occupied by the first four layers, indicated at N, is noticeably greater than that taken by the same number of shot in FIG. 6, indicated at L for the outer hexagonal rings, and at M only for the shot in the central column.

Another type of misorientation appears in the fifth layer in FIGS. 8 and 9, where only three shot are shown for greater clarity. These have dropped into crevices between the center and outer shot of the fourth layer. If allowed to remain in this position, they will permit only three more shot to enter this layer; each of these additional shot can occupy a position outside and tangent to one pair of the three shot already present. But space for a seventh shot has been lost from this layer.

By the use of my improved loading machine, the numbers of shot required for each layer are added in successive individual increments, and the shell is agitated sufficiently between these additions to afford an increased degree of probability that the shot will orient themselves in an orderly fashion to occupy the minimum volume. The amplitude and frequency of vertical shell reciprocation which will give satisfactory results for given shot sizes and load volumes can be readily determined by empirical methods. A short stroke may prove adequate, if there is a sharp deceleration at its ends that will rap the uppermost shot violently enough to reorient them properly.

What I claim is:

1. A machine for loading shot in successive layers into shotshells, comprising:

movable conveyor means constructed and arranged for receiving a series of shotshell casings with open mouths upwardly directed, and for indexing said casings successively to a series of shot-loading stations;

means constructed and arranged for simultaneously metering the individual charges of shot required for each of said layers and for dispensing said charges by gravity each at one said series of shot-loading stations, said metering means being located above said conveyor means to drop said charges each into a series of casings indexed to said shot-loading stations;

support means located beneath said conveyor means for supporting said casings for indexing by said conveyor means;

means drivingly connected with said support means constructed and arranged for repetitively reciprocating said support means through a stroke having a controlled vertical component of motion to shake the casings so as to cause the shot of each said individual charge to assume an orderly single-layer arrangement in the casings.

2. A shot loading machine as recited in claim 1, in which said reciprocating means comprise lever means pivotally supporting said support means and means for repetitively oscillating said lever means through a controlled arc.

3. A shot loading machine as recited in claim 2, in which said means for repetitively oscillating said lever means comprise cam and cam follower means constructed and arranged to oscillate said lever means.

4. A shot loading machine as recited in claim 3, said cam means having a working face cooperating with said cam follower means and having a repeated wave-form of predetermined amplitude and wavelength.

5. A shot loading machine as recited in claim 1, in which said reciprocating means comprise ram means constructed and arranged for reciprocation through a controlled stroke with respect to said conveyor means, and cam and cam follower means drivingly connected between said ram means and said support means.

6. A shot loading machine as recited in claim 5, said reciprocating means further including lever means pivotally supporting said support means and drivingly connecting said cam and cam follower means with said support means.

7. A shot loading machine as recited in claim 1, in which said support means comprise a plurality of rail segments arranged to support said shotshell casings at different ones of said shot-loading stations, and said reciprocating means are constructed and aranged to reciprocate said rail segments independently of one another.

8. A shot loading machine as recited in claim 1, said support means being formed with a groove for conformably and slidably receiving said shotshell casings, said groove having an undercut cross-section to secure said casings against substantial vertical motion with respect to said support means.

9. A machine for loading shot in successive layers into shotshells, comprising:

rotatable conveyor dial means constructed and arranged for receiving a series of shotshell casings with open mouths upwardly directed, and for indexing said casings successively to a series of shot-loading stations spaced arcuately about said dial means;

means constructed and arranged for simultaneously metering the individual charges of shot required for each of said layers and for dispensing said charges by gravity each at one of said series of shot-loading stations, said metering means being located above said dial means at said shot-loading stations to drop said charges each into one of a series of casings indexed to said shot-loading stations;

rail means located beneath said dial means and extending through the arc of said shot-loading stations for supporting said casings for indexing by said dial means;

and means drivingly connected with said rail means constructed and arranged for repetitively reciprocating said rail means through a stroke having a controlled vertical component of motion to shake the casings so as to cause the shot of each said individual charge to assume an orderly single-layer arrangement in the casings.

* * * * *

UNITED STATES PATENT AND TRADEMARK OFFICE

CERTIFICATE OF CORRECTION

PATENT NO. : 4,148,243

DATED : APRIL 10, 1979

INVENTOR(S) : ALBERT W. G. ERVINE

It is certified that error appears in the above-identified patent and that said Letters Patent are hereby corrected as shown below:

Col. 1, Line 51, "be" first occurrence should read as "in";
Col. 3, Line 36, "16" should read as "116";
Col. 5, Line 59, after "one" insert "of";
Col. 5, Line 62, after "into" insert "one of".

Signed and Sealed this

*Twenty-fourth* Day of *July 1979*

[SEAL]

*Attest:*

*Attesting Officer*

LUTRELLE F. PARKER

*Acting Commissioner of Patents and Trademarks*